United States Patent [19]

Bennett

[11] Patent Number: 4,713,959

[45] Date of Patent: Dec. 22, 1987

[54] TOOL FOR COUPLING SECTIONS OF AIR CONDITIONING DUCTS

[76] Inventor: Richard Bennett, 1600 E. Ocean Blvd. #8, Long Beach, Calif. 90802

[21] Appl. No.: 868,686

[22] Filed: May 30, 1986

[51] Int. Cl.[4] ..... B21D 7/06

[52] U.S. Cl. ..... 72/410; 72/412; 29/243.5; 81/426

[58] Field of Search ..... 29/243, 243.5, 243.56; 72/409, 410, 412, 416; 81/418, 419, 420, 424.5, 426, 426.5, 186

[56] References Cited

U.S. PATENT DOCUMENTS

| | | | |
|---|---|---|---|
| 1,435,150 | 11/1922 | Carpenter | 81/426 |
| 1,751,155 | 3/1930 | Heny et al. | 81/426 |
| 3,178,926 | 4/1965 | Logan | 72/410 |
| 4,318,211 | 3/1982 | Hoskinson | 29/243.5 |
| 4,403,497 | 9/1983 | Matteucci | 72/409 |
| 4,640,117 | 2/1987 | Anderson et al. | 72/410 |

*Primary Examiner*—Robert L. Spruill
*Assistant Examiner*—Donald R. Studebaker
*Attorney, Agent, or Firm*—Charles H. Thomas

[57] ABSTRACT

A tool is especialy adapted for use in fastening together sections of ducts used to conduit air for heating and air conditioning. The tool is comprised of a pair of tongs having opposing handles and jaws and hinged to rotate relative to each other about a transverse axis. The jaws are specially formed to facilitate insertion of angle shaped corner fasteners into the transverse, marginal flanges which project from the ends of conventional air conditioning duct sections and to bend over and collapse the peripheral lips on the marginal flanges of the duct sections back onto the legs of the reinforcement angles.

18 Claims, 8 Drawing Figures

TOOL FOR COUPLING SECTIONS OF AIR CONDITIONING DUCTS

BACKGROUND OF THE INVENTION

1. Field of the Invention

The present invention relates to a tool especially adapted for use in fastening together sections of heating and air conditioning ducts.

2. Description of the Prior Art

Conventional heating and air conditioning ducts in residential, commercial and industrial buildings are assembled from a number of separate duct sections which are manufactured in lengths small enough to be transported to a job site. The duct sections are formed of galvanized, cold-rolled sheet steel, typically of 18 or 20 guage thickness. The duct sections are manufactured in the shape of hollow, rectangular prisms, open at both ends and having flanges which extend transversely outward a short distance at the open ends perpendicular to the sides of the duct sections. The peripheral edges of the flanges are bent back to a disposition parallel to the sides of the duct sections from which the flanges transversely project. The peripheral edges of the flanges thereby define lips which extend a short distance perpendicular to the flanges from which they are formed and parallel to the sides of the duct sections from which the flanges transversely project. Each of the lips is formed of a fold of metal to double the effective thickness of the lip so as to provide additional reinforcement.

In cross section, the flanges and lips form a generally "L-shaped" configuration with the side of the duct from which they project at the open end of the duct section. The sides, flanges, and lips of each duct section are all formed from a single, unitary sheet of cold-rolled metal. Due to this manner of fabrication, the flanges and lips do not extend around the corners of the duct sections, but terminate at right angles relative to the corresponding flanges and lips that project from adjacent sides of the duct sections.

Angle shaped corner fasteners, manufactured of cold-rolled sheet steel and punched with apertures adapted to receive fasteners, such as bolts, are used as the primary means of connecting adjacent duct sections together. The corner angle fasteners each have a pair of legs intersecting at right angles. The two perpendicular legs of a corner angle are seated upon the surfaces of the adjacent mutually perpendicular flanges projecting from adjacent sides of a duct section. Four corner angle fasteners are seated on the flanges at each end of a duct section for coupling to another duct section. Similarly, the legs of four other corner angle fasteners are seated flush upon the flanges projecting from adjacent sides of another duct section to be joined to the first duct section. Bolts are then passed through each pair of facing corner angle fasteners, thereby compressing the flanges at the abutting ends of the duct sections therebetween. The juxtaposed faces of the flanges are previously coated with an adhesive sealant to prevent the leakage of air at the duct section interface.

For ducts of large cross section it is necessary to provide intermediate clamps to compress the interior portions of juxtaposed flanges together between the corner angles. These clamps are generally C-shaped in cross section and capture the lips of juxtaposed flanges therebetween.

In present practice in the installation of heating and air conditioning ductwork, the assembly together of duct sections is an arduous, laborious and time comsuming process. The corner angle fasteners are of a size designed to nest snugly in contact with the flanges and are designed to be confined between the walls of the sides of the duct sections and the lips protruding from the flanges. Indeed, the breadth of the flanges is such, that according to conventional practice, they must be pounded into place to seat in contact against the flanges using a steel hammer or mallet. Furthermore, to hold the corner angle fasteners in place, it is conventional practice to use a steel hammer or mallet to turn over the ends of the lips projecting from the flanges at the terminal ends of the flanges to thereby entrap the corner angles against the flanges. Also, it is conventional practice to deform the clamps that are located intermediately between the corner angle fasteners to firmly compress the intermediate portions of the flanges together using a steel hammer or mallet.

A steel hammer or mallet has heretofore been used as the primary tool in the assembly of heating and air conditioning duct sections. Age-old tools of this type have been available and have, for many centuries, been used to deform and work metal into a desired shape. However, as previously noted, the assembly of heating and air conditioning duct sections together using such a general purpose tool is extremely arduous and time consuming.

Using a conventional hammer or mallet a time of from approximately 8 to 12 minutes is required to fasten the facing four corner sections of two duct sections together. Competent tradesmen who perform such work, like others in the construction industry, are typically paid on an hourly basis and the expenses for labor in installing heating and air conditioning ducts are very significant. Duct sections may vary in lengths from less than two feet to greater than eight feet, and even a relatively small installation involves the coupling together many duct sections. The time involved in coupling duct sections together is further lengthened where the ducts include a number of branches and turns, since relatively short duct sections and multiple couplings are required in such instances. Each coupling interface requires approximately the same time for completion, regardless of the length of the duct sections involved.

A further disadvantage of the use of conventional hammers and mallets to couple together duct sections is that the operation is extremely noisy. Additional heating and air conditioning ductwork is often installed in existing buildings where commercial and industrial operations are taking place only a short distance from the areas of new duct installation. Although it is frequently not difficult to physically separate the areas of construction from the operating office and commercial space so as to prevent disruption of continuing business and manufacturing operations, the noise produced by hammering the duct flanges, corner angle fasteners and clamps permeates the entire surrounding area and is frequently so disruptive as to bring day-to-day business operations to a standstill.

SUMMARY OF THE INVENTION

The present invention is a new and unique tool for use in connecting together sections of air conditioning and/or heating ducts together. The tool of the invention is comprised of a pair of cooperating first and second levers which are joined at a fulcrum at their extremities to define opposing handles on one side of the fulcrum and opposing jaws on the opposite side of the fulcrum. The arrangement of the levers or tongs is very similar to that employed in connection with metal shears or pliers. However, the configuration of the jaws of the levers or tongs is extremely unique and the jaws are especially adpated for use in coupling together sections of steel ducts. Specifically, the jaw of the first lever has a bearing surface including a flat face and a heel disposed at right angles to each other to concavely face the jaw of the second lever. The jaw of the second lever is of a U-shaped configuration and concavely faces the jaw of the first lever. The jaw of the second lever is channel shaped with a flat floor, a lip, and a heel. The heel is configured to extend outwardly from the flat floor between the flat floor and the fulcrum of the pair of levers and is aligned to bear against the heel of the first lever. The edge of the heel on the jaw of the second lever that is remote from the fulcrum and proximate to the flat floor is chamfered. The lip of the jaw of the second lever projects outwardly from the flat floor to bear against a portion of the bearing surface of the jaw of the first lever.

The invention may be described with greater clarity and particularity by reference to the accompanying drawings.

DESCRIPTION OF THE DRAWINGS

FIG. I is a side elevational view of one preferred embodiment of a tool according to the invention.

DESCRIPTION OF THE EMBODIMENT

Figure 1:
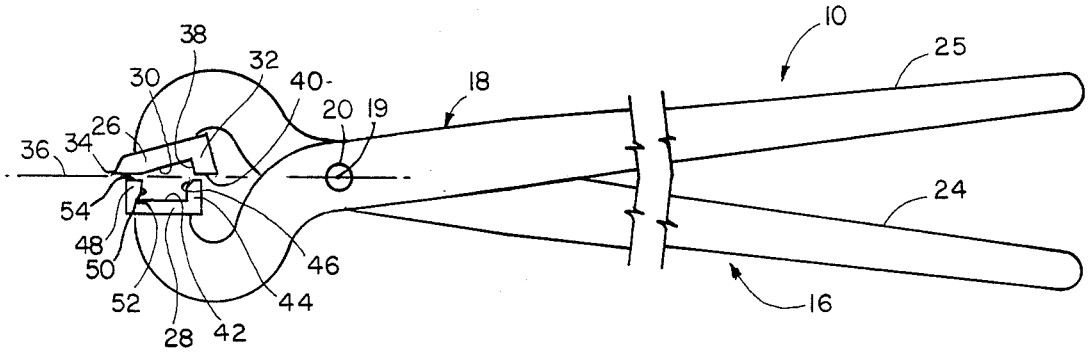
Figure 6:
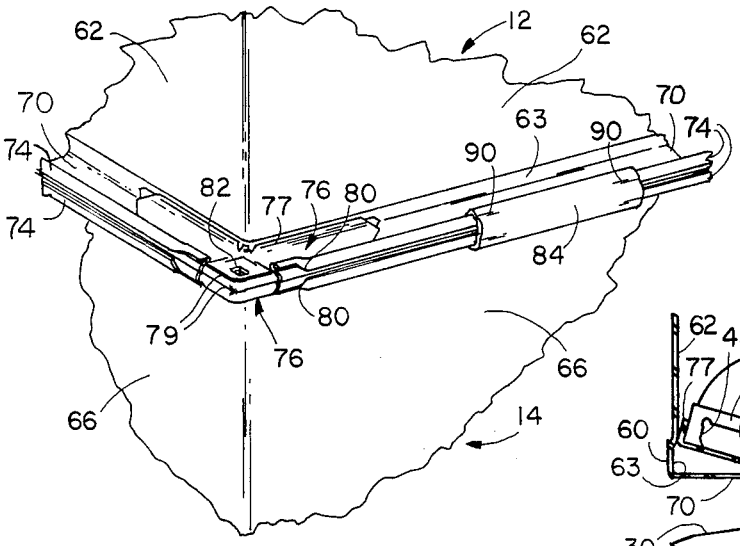
FIG. 6 is a perspective view showing two air conditioning duct sections coupled together using the embodiment of the tool as depicted in FIG. 1.

FIG. 1 illustrates one preferred embodiment 10 of a tool according to the invention which is especially adapted for use in coupling together sections of air conditioning ducts that are indicated at 12 and 14 in FIG. 6. The tool 10 is comprised of a pair of tongs 16 and 18. The tongs 16 and 18 serve as first and second levers or lever elements, respectively. The tongs 16 and 18 are hinged together at a fulcrum formed by a transverse axis 19 of mutual rotation. A cylindrical steel pin 20, flattened at both ends to capture the tongs 16 and 18 therebetween, serves as the fulcrum and axle for relative rotation of the tongs 16 and 18. The tongs 16 and 18 define handles 24 and 25 and jaws 26 and 28, respectively.

Figure 7:
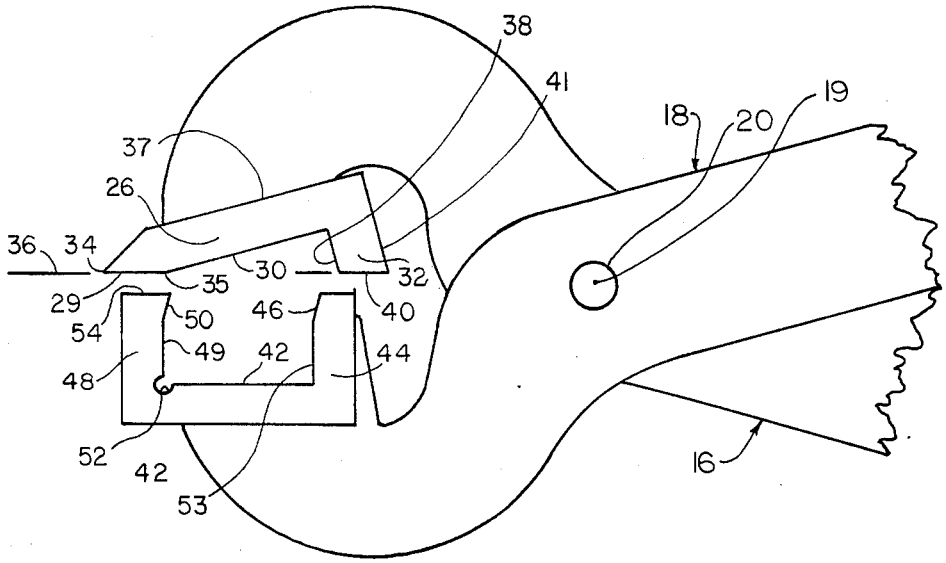
FIG. 7 is an enlarged elevational detail showing the configuration of the jaws of the embodiment of the tool as depicted in FIG. 1.

The jaw 26 of the first tong or lever element 16 is angle shaped in cross section and is formed with a bearing surface 29 having a flat, planar face 30 and a heel 32 projecting perpendicular from the flat face 30, as best depicted in FIG. 7. The flat face 30 is inclined at an acute angle relative to a plane 36 containing the axis of rotation 19 at the fulcrum of the tool and intersecting the extemity 34 of the bearing surface 29 most remote from the axis 19. This plane 36 is viewed on edge in FIG. 7. Preferably, the acute angle of inclination of the flat face 30 of the jaw 26 of the first tong lever element 16 relative to the plane 36 is about twelve degrees. The breadth of the flat planar face 30 is preferably about five-eighths of one inch as measured from the demarcation 35 to the interior face 38 of the heel 32. The bearing surface 29 also includes a lanar abutment face 33 located at the extremity of the surface 29 remote from the transverse axis 19 and formed at a reflex angle of about 185 degrees relative to the flat face 30. The abutment face 33 ad the flat face 30 are separated by the demarcation 35. The breadth of the abutment face 33 from the demarcation 35 to the extremity 34 on the bearing surface 29 is preferably about five-sixteenths of one inch. The bearing face 40 of the heel 32 is formed at a slight obtuse angle relative to the interior surface 38. The jaw 26 is about one-fourth of one inch thick between the flat face 30 and the back side 37. The heel 32 is also about one quarter inch in thickness and the back surface 41 of the heel 32 is about seven-sixteenths of an inch wide, all as viewed in FIG. 7.

The jaw 28 of the second tong element 18 is formed as a U-shaped channel defining a flat floor 42 bounded on a side toward the axis 19 by an outwardly projecting heel 44 chamfered at its projecting interior edge as indicated at 46. The heel 44 is aligned to bear in opposition in overlapping fashion against the heel 32 of the jaw 26 of the first tong lever element 16 when the tongs 16 and 18 are closed. The heel 44 of the jaw 28 projects outwardly from the flat floor 42 a distance of about three-eighths of an inch. The chamfered surface 46 of the heel 44 is preferably oriented at an angle approximately 45 degrees relative to the flat floor 42. The flat floor 42 of the channel of the jaw 28 is bounded on a side away from the axis 19 by an outwardly projecting lip 48 which is aligned to bear against the abutment face 33 of the bearing surface 29 proximate to the extremity 34 of the jaw 26 of the first tong lever element 16 at a spaced distance from the heel 32 of the jaw 26.

The lip 48 of the jaw 28 defines an interior face 49 which includes a projecting portion 50 disposed at an acute angle, preferably about 70 degrees, relative to the flat floor 42 of the jaw 28. As illustrated, a concave groove 52 is defined at the intersection of the interior face 49 and the flat floor 42. The groove 52 is of a arcuate cross section formed at a radius of about one-eighth of an inch. The circular arc of the groove 52 preferably extends over a reflex angle of about 190 degrees. The lip 48 is therefore about one thirty-second of an inch thicker at its extremity at its bearing surface 54 remote from the flat floor 42 than at its conjunction therewith at the groove 52. Like the heel 44, the lip 48 projects outwardly away from the floor 42 a distance of three-eighths of an inch. The flat floor 42 of the jaw 28 is about seventeen thirty-seconds of an inch in breadth from the groove 52 to the interior surface 53 of the heel 44 that is perpendicular thereto. The lip 48 is three-sixtenths of an inch wide a the bearing surface 54 and the heel 44 is also three-sixteenths of an inch thick at its thickest portion.

Figure 3:
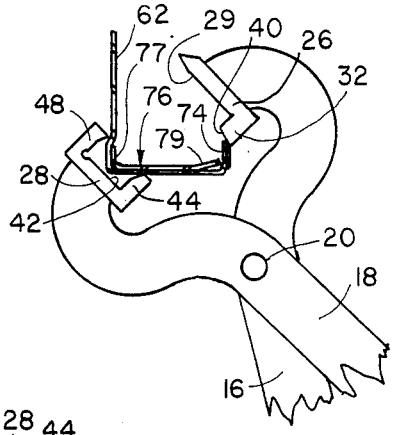
FIG. 3 is an elevational sectional detail illustrating use of the tool of FIG. 1 to turn over the lip of a flange on a section of air conditioning duct.
Figure 2:
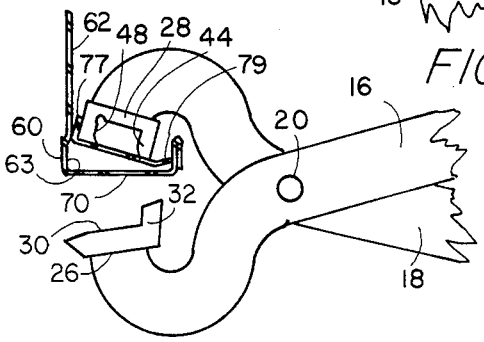
FIG. 2 is a side elevational sectional detail illustrating use of the tool of FIG. 1 for installing a corner angle fastener against the flange of a duct section.

The tool 10 can be utilized to perform all of the necessary functions to couple together two sections of air conditioning ducts. FIG. 6 illustrates the manner in which two air conditioning duct sections 12 and 14 are fastened together utilizing the tool 10 of the invention. Two intersecting sides 62 of the duct section 12, formed at right angles to each other, are depicted in FIG. 6. Likewise, two adjacent perpendicular sides 66 of the duct section 14 are also illustrated. The abutting, open ends of the duct sections 12 and 14 include transversely projecting flanges 70 with lips 74 turned perpendicular thereto, as best illustrated in FIGS. 2 and 3. The peripheral margins of the sheet metal structures, are folded over to produce lips 74 of double thickness, as illustrated. Together with the side walls of the duct sections, the flanges 70 and lips 74 thereon are arranged in a generally L-shaped cross sectional configuration, as illustrated in FIGS. 2 and 3.

Reinforcement corner angle fasteners 76 for attaching the duct sections 12 and 14 together are employed at each of the corners of the abutting duct sections 12 and 14. The corner angle fasteners 76 are described in U.S. Pat. No. 4,466,641. Each corner angle fastener 76 is of a generally L-shaped configuration having inner and outer edges 77 and 79, respectively, turned upwardly to form stiffening inner and outer rims. A square opening 82 at the angle apex is provided to receive fastening bolts.

FIG. 2 illustrates the manner in which the tool 10 is employed to seat the legs of the corner fasteners 76 flush against the flanges 70 and between the side walls 62 and the lips 74. Specifically, each corner angle 76 is first positioned so that its outer edge 79 is seated at the demarcation between a lip 74 and a flange 70, as illustrated in FIG. 2. The width of the legs of the corner angle fasteners 76 is intentionally designed so that the fasteners 76 will seat flush against the flanges 70 only if forced down between the lips 74 and the side walls 62. To this end, the tong lever elements 16 and 18 are rotated relative to each other from the positions of FIG. 2 to clamp the jaws toward each other, with the jaw 28 bearing against the top of a leg of the corner angle fastener 76, and with the jaw 26 bearing against the underside of the flange 70. The legs of the corner angle fasteners 76 are thereby forcibly pushed down flush against the upper surface of the flange 70, to a disposition illustrated in FIG. 3.

Once the legs of the corner angles fasteners 76 have been seated between the side walls 62 and the lips 74, it is necessary to turn the lips 74 over to firmly entrap the corner angle fasteners 76 and secure them to the flanges 70. To perform this function, the tongs 16 and 18 of the tool 10 are turned over from the positions of FIG. 2 as depicted in FIG. 3 so that the bearing surface 40 of the heel 32 of the jaw 26 is positioned against the lip 74 just above the leg of the corner fastener 76. At the same time, the heel 44 of the jaw 28 is positioned against the inside surface of the duct section side wall 62 at a location that is reinforced by the upstanding interior edge 77 of the corner angle fastener 76. The handles 24 and 26 are pressed toward each other to close the jaws 26 and 28, thereby partially collapsing the lip 74 over the outer edge 79 of the corner angle 76.

Figure 4:
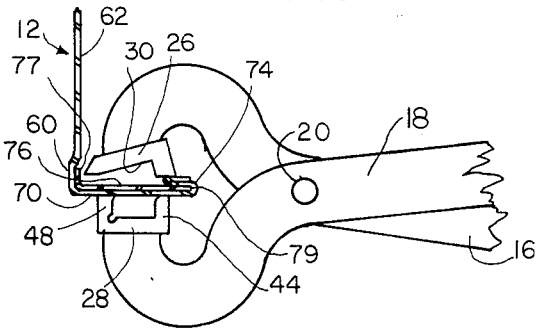
FIG. 4 is an elevational sectional detail illustrating securement of the corner angle fastener against an air conditioning duct flange.

The lip 74 can be completely turned over to securely hold the corner angle fastener 76 in intimate contact with the flange 70 by moving the jaws 26 and 28 from the position of FIG. 3 to the orientation of FIG. 4. The jaws 26 and 28 are then again closed toward each other to totally collapse the lip 74 upon the outer edge 79 of the entrapped leg of the corner angle fastener 76 between the heels 32 and 44 of the jaws 26 and 28 respectfully. Collapsed sections of lips 74 are indicated at 80 in FIG. 6.

Once the corner angle fasteners 76 have been installed at each corner of each duct section, they will reside in abutment against each other. Bolts can then be passed through the aligned bolt apertures 82 indicated in FIG. 6 to fasten the duct sections 12 and 14 together.

Figure 5:
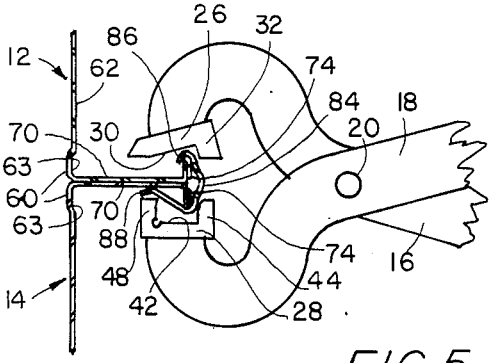
FIG. 5 is an elevational detail illustrating the crimping of a clamp to hold two adjacent duct sections in intimate contact with each other.

The jaws 26 and 28 of the embodiment 10 of the tool are also especially configured to install clamps, such as the clamp 84 depicted in FIG. 6 upon intermediate portions of the flanges 70 between adjacent corner angle fasteners 76 of each of the duct sections. The clamp 84 is originally configured having roughly the cross sectional shape of the number "7", as depicted in FIG. 5. A lip 86 along the upper edge of the clamp 84 captures the lip 74 of one side wall 62 of the duct section 12, while the lip 74 of the duct 14 is captured at a pocket in the central portion of the clamp 84. The trailing edge 88 of the clamp 84 resides in contact with the flange 70 extending transversely from the duct section 14.

To crimp the clamps 84 onto the lips 74 of the abutting duct sections 12 and 14, the jaws 26 and 28 are placed as depicted in FIG. 5. That is, the flat face 30 of the jaw 26 is positioned to press against the lip 86 of the clamp 84, while the upper interior edge of the lip 48 formed at the intersection of the surfaces 54 and 50 thereof is positioned to press against the portion 88 of the clamp 84. The jaws 26 and 28 are thereupon forced toward each other so that the edge 88 of the clamp 84 is fully collapsed onto the flange 70 of the duct section 14. At the same time, the opposing forces exerted by the flat surface 30 of the jaw 26 and the flat surface 42 of the jaw 28 deform both the structure of the clamp 84 and the sections of the lips 74 entrapped therewithin at the longitudinal location where the force is applied. The clamp 84 is crimped at both ends, and the collapsed sections are indicated at 90 in FIG. 6. The juxtaposed surfaces of the flanges 70 are typically precoated with an adhesive sealant so that they are adequately held together by clamps 84, and so that a substantially leak free interface is formed.

By using the embodiment 10 of the tool of the invention, duct sections can be coupled together far more rapidly and with far less noise than is currently possible. An individual tradesman of some experience in assembling air conditioning ducts can typically secure about 20 joints, over a period of approximately 4 hours, using a conventional hammer or mallet to perform the metal bending and crimping functions which can be performed with the tool of the invention. Using the tool of the invention, however, the same tradesman can secure approximately one hundred joints over the same period of time. The tool of the invention thereby increases the rate of assembly of duct sections by a factor of five. Quite evidently, this drastically reduces the cost of installation of heating and air conditioning duct systems.

The embodiment 10 of the tool of the invention is useful both for installing corner angle fasteners 76 and for installing clamps 84. This embodiment is preferred for installing duct sections at job sites. However, it is sometimes advantageous to install the corner fasterners 76 on the flanges 74 prior to shipping the duct sections to the job site. For such shop work, a second, alternative embodiment 90 of the tool of the invention, depicted in FIG. 8, may be preferred.

The embodiment 90 of the tool of the invention, like the embodiment 10 is comprised of a pair of co-operating first and second tongs or levers 92 and 94, respectively which are joined at a fulcrum 96 between their extremities to define opposing handles 98 and 100 on one side of the fulcrum 96 and opposing jaws 28 and 28' on the opposite side of the fulcrum 96. The jaw 28' is identical to the jaw 28 on the tong 18 of the embodiment 10 depicted in FIGS. 1–7. The jaw 28' is formed in mirror image configuration with the jaw 28 and the corresponding elements and surfaces of the jaw 28' are indicated by primed counterparts to the elements and surfaces of the jaw 28. That is, for example the flat face 42' of the bearing surface 29' of the jaw 28' of the first lever 92 is formed in mirror image relative to the floor 42 of the jaw 28 of the second lever 94 and is parallel thereto when the jaws 28 and 28' are closed. The bearing surface 29' of the first lever 92 also includes a lip 48' formed in mirror image relative to the lip 48 of the second lever 94. The other surfaces of the jaw 28' are likewise configured in mirror image relative to the corresponding surfaces of the jaw 28.

The embodiment 90 has an advantage over the embodiment 10 in that the tongs 92 and 94 do not need to be turned over as do the tongs 16 and 18 of the embodiment 10, in order to collapse the lips 74 onto the legs of the angle fasteners 76, once the legs of the angle fasteners 76 have been seated on the flanges 70. That is, the tongs 16 and 18 of the embodiment 10 must be reversed in orientation from the disposition of FIG. 2 to the disposition of FIG. 3. No corresponding reversal is necessary with the embodiment 90, since the jaws 28 and 28' are formed in mirror image configuration relative to each other. Consequently, the installation of corner angle fasteners 76 can be performed even more rapidly with the embodiment 90 of the tool of the invention than with the embodiment 10.

Figure 8:
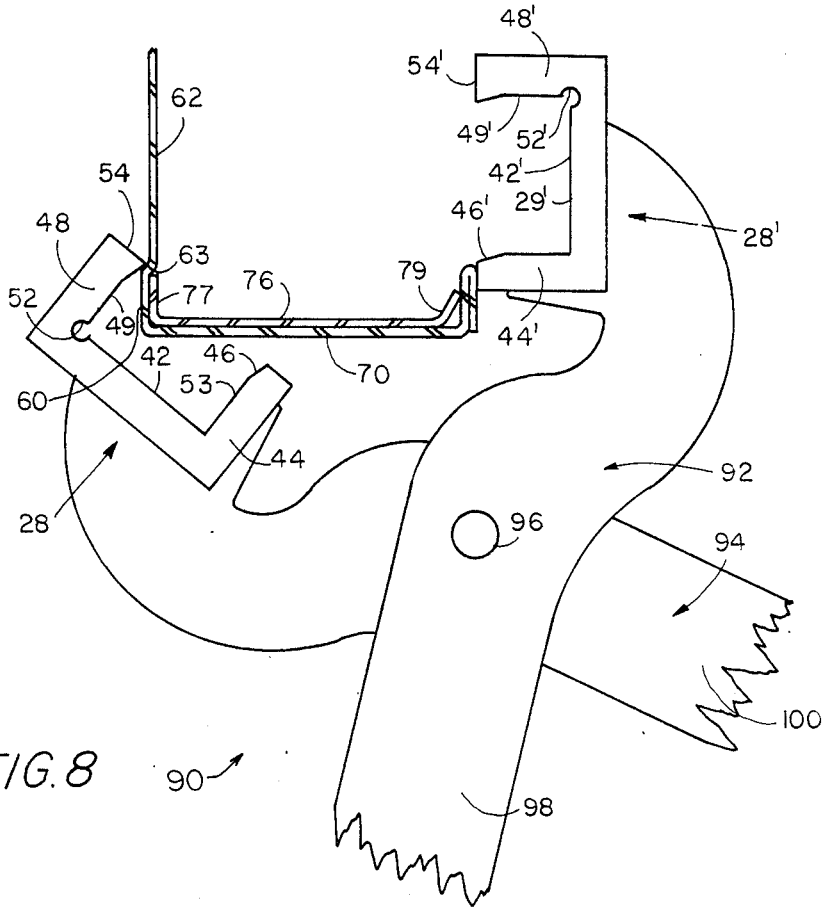
FIG. 8 is an enlarged elevational detail showing the configuration of the jaws of another embodiment of the tool of the invention in use.

The speed of corner angle fastener installation is further enhanced using both the embodiment 10 and the embodiment 90, since the lip 48 of the jaw 28 hooks over a slight inwardly directed protrusion 60 at the interior corner formed at the demarcation between the inside of the side wall 62 and the flange 70, as best depicted in FIG. 8. The protrusion 60 serves to form a slight recess 63 where the base of the side wall 62 is turned out to form the flange 70. This recess is particularly adapted to receive and entrap the rim 77 of the corner fastener 76 when the jaw 28' (or the jaw 26) is brought to bear in opposition against the jaw 28 to collapse the lip 74 and push the rim 77 into the recess 63.

The embodiment 10 can be used by two skilled duct installers to completely install approximately 544 corner angle fasteners 76 on duct sections in approximately 58 minutes. The same installers can install the same number of corner angle fasteners 76 on duct sections in approximately 45 minutes using the embodiment 90 of the tool of the invention. The embodiment 10 of the tool of the invention is preferred for installing the clamps 84, however.

Undoubtedly, numerous other variations and modifications of the invention will become readily apparent with those familiar with the assembly of heating and air conditioning duct systems. Accordingly, the scope of the invention should not be construed as limited to the specific embodiment depicted and described herein, but rather is defined in the claims appended.

I claim:

1. A tool for use in connecting together sections of air conditioning ducts comprising a pair of co-operating first and second levers which are joined at a fulcrum between their extremities to define opposing handles on one side of said fulcrum and opposing jaws on the opposite side of said fulcrum, and said jaw of said first lever has a bearing surface including a flat face and a heel disposed at right angles to each other to concavely face said jaw of said second lever, and said jaw of said second lever is of a U-shaped configuration concavely facing said jaw of said first lever and has a flat floor, a heel and a lip, configured so that said heel of said jaw of said second lever extends outwardly from said flat floor between said flat floor and said fulcrum and is aligned to bear against said heel of said jaw of said first lever, and the edge of said heel of said jaw of said second lever remote from said fulcrum and proximate to said flat floor is chamfered, and said lip projects outwardly from said flat floor to bear against a portion of said bearing surface of said jaw of said first lever.

2. A tool according to claim 1 further characterized in that said lip of said jaw of said second lever defines an interior face including an upper surface disposed at an acute angle relative to said flat floor of said jaw of said second lever.

3. A tool according to claim 1 further characterized in that said acute angle is about 70 degrees.

4. A tool according to claim 3 further characterized in that a concave groove is defined at an intersection of said interior surface of said lip and said flat face of said jaw of said second lever.

5. A tool according to claim 4 wherein said groove is formed with an arcuate cross section at a radius of about one-eighth of an inch.

6. A tool according to claim 1 wherein said flat floor of said jaw of said second lever is about one-half inch in breadth.

7. A tool according to claim 1 wherein said flat face of said bearing surface is inclined at an acute angle relative to a plane containing said fulcrum and passing through the extremity of said bearing surface most remote from said fulcrum.

8. A tool according to claim 1 wherein said jaws are formed in mirror image configuration relative to each other in which said flat face of said bearing surface of said jaw of said first lever is formed in mirror image relative to said floor of said jaw of said second lever and is parallel thereto when said jaws are closed, and said bearing surface of said first lever also includes a lip formed in mirror image relative to said lip of said second lever.

9. A tool specially adapted for use in coupling together sections of air conditioning ducts comprising a pair of tongs including first and second lever elements hinged together at a fulcrum formed by a transverse axis of mutual rotation, a jaw defined on said first lever element including a bearing surface having a flat planar face and a heel defined on said first lever element projecting perpendicular from said flat planar face, and said flat planar face is inclined at an acute angle relative to a plane containing said axis of rotation at said fulcrum and intersecting the extremity of said bearing surface most remote from said axis, and a jaw is defined on said second lever element and is formed as a U-shaped channel having a flat floor, an outwardly projecting heel of said second lever element, and an outwardly projecting lip, and said flat floor is bounded on a side toward said axis by said outwardly projecting heel of said second lever element, and said heel of said second lever element has a projecting interior edge which is chamfered and is aligned to bear in opposition against said heel of said first lever element when said tongs are closed, and said flat floor of said channel is bounded on a side away from said axis by said outwardly projecting lip and said outwardly projecting lip is aligned to bear against said bearing surface of said jaw of said first lever element a spaced distance from said heel of said first lever element.

10. A tool according to claim 9 further characterized in that said acute angle of inclination of said flat face of said jaw of said first lever element relative to said plane containing said axis of rotation is about 12 degrees.

11. A tool according to claim 9 further characterized in that said outwardly projecting lip is thicker at its extremity remote from said flat face of said channel than at its conjunction therewith.

12. A tool according to claim 11 in which said outwardly projecting lip defines an interior planar surface facing said heel of said jaw of said second lever element, and said interior planar surface is disposed at an angle of about 70 degrees relative to said flat floor of said channel.

13. A tool according to claim 12 wherein said outwardly projecting lip defines an interior face and a concave groove, and said interior planar surface of said outwardly projecting lip is a projecting portion of said interior face and said interior face is separated from said flat floor of said channel by said concave groove and said concave groove is defined in cross section by a circular arc having a radius of about one-eighth of an inch.

14. A tool according to claim 9 wherein said heel of said second lever element projects perpendicularly outwardly from said flat floor of said channel, and said interior edge of said heel is chamfered at an angle of about 45 degrees relative to said flat floor of said channel.

15. A tool for use in fastening together sections of air ducts comprising a pair of first and second tongs hinged to rotate relative to each other about a transverse axis and defining handles and jaws respectively located on opposite sides of said axis, wherein said jaw of said first tong is formed with a bearing surface that includes a flat face and said jaw of said first tong also includes a heel of said first tong projecting perpendicular to said flat face, and said jaw of said second tong is formed to define a channel having a flat floor, a heel of said second tong, and a lip of said second tong, and said flat floor is bounded on opposite sides by said heel of said second tong and by said lip of said second tong, and said heel of said second tong is chamfered at its upper interior edge and projects from said flat floor to meet said heel of said first tong when said jaws are closed, and said lip of said second tong projects outwardly from said channel floor to meet said bearing surface of said first jaw when said jaws are closed, and said lip of said second tong has an interior face including an upper flat interior surface oriented at an acute angle relative to said channel floor.

16. A tool according to claim 15 further characterized in that said acute angle is about 70 degrees.

17. A tool according to claim 15 in which said bearing surface of said jaw of said first tong also includes a lip of said first tong and said bearing surface includes a surface of said lip of said first tong which projects perpendicular to said flat face, and said flat face of said jaw of said first tong and said flat floor of said jaw of said second tong are parallel to each other when said jaws are rotated together.

18. A tool according to claim 15 in which said bearing surface also includes a planar abutment face located at the extremity of said bearing surface remote from said transverse axis and said planar abutment face is formed at a reflex angle relative to said flat face of said bearing surface of said first jaw of said first tong.

* * * * *